US005625914A

United States Patent [19]

Schwab

[11] Patent Number: 5,625,914

[45] Date of Patent: May 6, 1997

[54] AUTOMATIC MATTRESS SURFACE CONTOUR AND SUPPORT CHANGING APPARATUS WITH WAVE SENSORS

[76] Inventor: Patrick R. Schwab, 3 Greyswood Ct., Potomac, Md. 20854

[21] Appl. No.: 595,563

[22] Filed: Feb. 1, 1996

[51] Int. Cl.[6] ..... A47C 27/00; A61G 7/00

[52] U.S. Cl. ..... 5/690; 5/600; 5/652; 5/716; 5/936; 297/284.1

[58] Field of Search ..... 5/690, 716, 600, 5/693, 652, 655.7, 935, 936, 906, 706, 727

[56] References Cited

U.S. PATENT DOCUMENTS

| | | | |
|---|---|---|---|
| 3,340,548 | 9/1967 | Janapol | 5/936 |
| 3,604,027 | 9/1971 | Konno | 5/936 |
| 3,608,107 | 9/1971 | Kentor et al. | 5/936 |
| 3,656,190 | 4/1972 | Regan et al. . | |
| 4,222,137 | 9/1980 | Usami | 5/936 |
| 4,799,276 | 1/1989 | Kadish . | |
| 4,999,861 | 3/1991 | Huang . | |
| 5,283,735 | 2/1994 | Gross et al. | 5/935 |

*Primary Examiner*—Alexander Grosz
*Attorney, Agent, or Firm*—Marvin S. Townsend

[57] ABSTRACT

An automatic mattress surface contour and support changing apparatus includes a wave-emitter assembly which emits waves and is worn by a person lying in bed. A wave-responsive mattress/control assembly responds to the waves of the wave-emitter assembly for adjusting top surface support characteristics of the wave-responsive mattress/control assembly. The wave-responsive mattress/control assembly includes a plurality of signal-responsive, adjustable-height support assemblies and a top layer covering and supported by the plurality of signal-responsive, adjustable-height support assemblies. The top layer provides a top support surface for supporting the person in bed. A plurality of wave sensor assemblies are ready to sense waves from a wave-emitter assembly when the wave-emitter assembly moves substantially close to one or more of the wave sensor assemblies. With one embodiment, each wave sensor assembly is connected to an associated signal-responsive, adjustable-height support assembly. Each wave sensor assembly sends a height-reduction control signal to an associated signal-responsive, adjustable-height support assembly when waves are sensed by the wave sensor assembly. The height-reduction control signal causes the signal-responsive, adjustable-height support assembly to reduce its height, whereby the top surface support of the wave-responsive mattress/control assembly is retracted away from the wave-emitter assembly. With another embodiment, each wave sensor assembly is connected to a common control unit which controls a plurality of the signal-responsive, adjustable-height support assemblies in a variety of selectable predetermined patterns.

15 Claims, 6 Drawing Sheets

AUTOMATIC MATTRESS SURFACE CONTOUR AND SUPPORT CHANGING APPARATUS WITH WAVE SENSORS

BACKGROUND OF THE INVENTION

1. Field of the Invention

The present invention relates generally to mattresses and, more particularly, to mattresses whose surface contour and support are changed by active components in the mattress.

2. Description of the Prior Art

Generally, mattresses include passive springs which support the mattress surface. When a person lies down on the mattress, the surface contour of the mattress changes as a result of the weight of the person pressing down on the mattress surface and being supported by the passive springs. Mattresses filled with a fluid, i.e., water mattresses or air mattresses, also function passively because they respond only to weight pressing down on them. For weight that is supported by passive means, the mattress exerts an upward supporting force on each portion of the person's body that is being supported. Each upward force is equal and opposite to the downward force caused by the weight directly above it. This is the essence of passive support. When a portion of the person's body is sore, however, the upward force exerted by the passive springs can aggravate the pain. In view of these considerations, it would be desirable if a mattress were provided which reduced or minimized the upward force exerted by a mattress on sore portions of a person's body. In this respect, the portion of the weight of a person's body that is not supported by those mattress portions which exert reduced upward supporting forces would be redistributed to other portions of the mattress, which would function normally (passively).

Throughout the years, a number of innovations have been developed relating to mattresses for preventing or reducing pressure-sensitive soreness in a person lying on the mattress, and the following U.S. Pat. Nos. are representative of some of those innovations: 3,340,548, 3,656,190, 4,799,276, 4,999,861, and 5,283,735. More specifically, U.S. Pat. No. 3,340,548 discloses a mattress which contains a plurality of springs therein. The compression of springs is adjusted to accommodate a person's individual pattern of firmness/softness needs for the mattress. The specific pattern of firmness/softness is manually adjusted for each person. To adjust a mattress manually for each sore portion that a person may have on one's body may be a tedious chore. Furthermore, a sleeping person cannot make manual adjustments. In this respect, it would be desirable if a mattress were provided which automatically adjusted its surface contour and support to accommodate sore portions of a person's body. Stated somewhat differently, it would be desirable if a mattress were provided which automatically adjusted its surface contour and support. This would accommodate sore portions of a person's body and allow the portions of the person's weight not supported by the mattress to be redistributed to other portions of the mattress.

U.S. Pat. No. 5,283,735 discloses a feedback system for adjusting the load bearing surface in a chair or bed. A grid of pressure sensors is used to generate data indicating an actual force distribution on the load bearing surface, such as a mattress. The actual pressure distribution is compared with a desired pressure distribution. The upward pressure is exerted by pressure exerting devices, such as inflated bags, and is adjusted so that the actual pressure distribution approaches the pre-set desired pressure distribution. Although there is a degree of automatic surface contour and support adjustment, actual physical pressure is required to be exerted on the pressure sensors by a portion of a person's body in order to generate a pressure on the pressure sensors. This means that a sore portion of the body, such as a sore back, must exert a force on a pressure sensor before the surface contour is automatically adjusted. Such a pressure-exerting requirement of a sore portion of a person's body may still cause considerable pain. In this respect, it would be desirable if a mattress were provided which does not require a sore portion of a person's body to exert a downward force on a pressure sensor in order to automatically adjust the surface contour and support of a mattress.

Furthermore, the feedback system requires that the mattress location of the sore spot on a person's body be computed from an array of pressure distribution measurements using an electronic data processor. This computation could introduce errors in determining the mattress location of the sore spot. In this respect, it would be desirable if a mattress were provided which positively and continuously identifies the exact mattress location under the sore spot on the person with little or no data processing of an array of measurements.

U.S. Pat. No. 3,656,190 discloses a body support in the form of a bed which is designed to alleviate a person's discomfort caused by bed sores. A cyclically repeated wave-like motion of the surface contour and the associated upward force distribution is carried out by using a plurality of spring-based movable elements distributed in a grid array beneath the surface. Each movable element can have its spring compression varied. The pattern of spring compression variation is predetermined and is not responsive to any particular body portion. Once a bed sore has formed, such a cyclically repeated wave-like variation in surface contour would subject the bed sore to cyclically repeated wave-like contact and pain. In this respect, it would be desirable if a mattress were provided which reduces pain engendered by bed sores by preventing the bed sores from being exposed to any contact with or upward force from the mattress, including cyclically repeated wave-like contact.

U.S. Pat. No. 4,799,276 discloses a grid array of devices (pistons) which undergo cyclic variation with respect to the upward pressure exerted by the devices on a patient in order to alleviate bed sores. The pressure exerted by the patient's body sections against their respective support pistons is constantly measured. Adjustments of pressure exerted by the pistons depends upon the measured pressures. Actual downward physical pressure is required to generate a pressure on the sensors. As stated above, it would be desirable if actual downward physical pressure on a pressure sensor were not required in order to alleviate pain engendered by bed sores or by a sore back. As also stated above, it would be desirable if the mattress prevented the bed sores or sore back from being exposed to any contact with or upward force from the mattress, including cyclically repeated contact.

U.S. Pat. No. 4,999,861 is similar to above-discussed U.S. Pat. No. 3,656,190 for a disclosure of a wave motion bed which cyclically sends waves of firmness and softness under a bed surface to alleviate bed sores. Devices which vary the firmness and softness are plates that are raised and lowered by cams. This device presents similar problems to those presented by U.S. Pat. No. 3,656,190.

Still other features would be desirable in an automatic mattress surface contour and support changing apparatus. For example, a patient may have a sore back or a burn that covers a relatively large portion of the person's body. In this respect, it would be desirable if a relatively large portion of a supporting mattress retract when a relatively large sore area approaches the mattress.

Patients with pain in the lumbar region of the lower back often sleep on an extra firm surface to minimize the upward force on their lower back. Alternatively, they may sleep with their knees and/or head elevated in order to correct the curvature of the lower spine. It would be desirable if the portion of the mattress under the lower spine retracted, as this would remove the upward force on this part of the spine and contribute to the relief of lower back pain.

Thus, while the foregoing body of prior art indicates it to be well known to use mattresses which change surface contours and supports to redistribute weight and relieve pressure on certain body parts, the prior art described above does not teach or suggest an automatic mattress surface contour and support changing apparatus which has the following combination of desirable features: (1) positively and continuously identifies the exact mattress location(s) which are under the sore portion(s) of a person's body reclining on the mattress, even if the person moves on the mattress; (2) reduces or minimizes the upward force exerted by a mattress on sore portions of a person's body; (3) automatically adjusts its top surface contour and support to accommodate sore portions of a person's body; (4) does not require a sore portion of a person's body to exert a downward pressure on a pressure sensor in order to adjust the surface contour of a mattress; (5) reduces pain engendered by bed sores by preventing the bed sores from being exposed to cyclically repeated wave-like contact with a mattress surface; (6) automatically adjusts its top surface contour and support (upward force distribution) to accommodate sore portions of a person's body so that portions of the person's weight that are not supported by the mattress are redistributed to other portions of the mattress; and (7) can provide that a relatively large portion of a supporting mattress retracts when a relatively large area on a patient approaches the mattress. The foregoing desired characteristics are provided by the unique automatic mattress surface contour and support changing apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides an automatic mattress surface contour and support changing apparatus which includes a wave-emitter assembly which is worn by a person and which emits a field or waves. For the purposes of the present invention, fields and waves are deemed to be equivalent. The wave-emitter assembly is worn at or near a sore portion of the person's body to identify the location of the sore portion. A wave-responsive mattress/control assembly responds to the waves of the wave-emitter assembly for adjusting top surface support characteristics of the wave-responsive mattress/control assembly.

The wave-responsive mattress/control assembly includes a housing assembly, a plurality of signal-responsive, adjustable-height support assemblies housed within the housing assembly, and a top layer covering and supported by the plurality of signal-responsive, adjustable-height support assemblies and providing a top support surface for supporting the person. A plurality of wave sensor assemblies are ready to sense waves from a wave-emitter assembly when the wave-emitter assembly moves substantially close to one or more of the wave sensor assemblies.

In accordance with one embodiment of the invention, each wave sensor assembly is connected to an associated signal-responsive, adjustable-height support assembly. Each wave sensor assembly sends a height-reduction control signal to an associated signal-responsive, adjustable-height support assembly when waves are sensed by the wave sensor assembly. The height-reduction control signal causes the signal-responsive, adjustable-height support assembly to reduce its height, whereby the top surface support of the wave-responsive mattress/control assembly is adjusted, that is, retracted away from the wave-emitter assembly.

The wave-emitter assembly can include a permanent magnet which emits magnetic waves. A non-magnetic jacket surrounds the permanent magnet. For such an emitter, the wave sensor assemblies could be comprised of reed switch-based sensors. Each reed switch-based sensor includes a reed switch.

Preferably, each signal-responsive, adjustable-height support assembly includes an adjustable-length spring assembly and a compression/expansion assembly connected to the adjustable-length spring assembly. In one variation, the spring is supported by a rigid plate which includes an access opening directly below the center line of the spring. A compression/expansion assembly is located beneath the plate and inside the spring along its center line. The compression/expansion assembly can include an electric motor and a wire which serves as a flexible compression cable. One end of the wire is passed through the access opening and is attached to the top of the spring by means of a rigid disk. The electric motor pulls the wire down through the access opening in the plate and thus compresses the spring.

In accordance with another embodiment of the invention, each wave sensor assembly is connected to a common control unit. The common control unit sends a height-reduction control signal to one or more of the signal-responsive, adjustable-height support assemblies when waves are sensed by one or more of the wave sensor assemblies. The one or more height-reduction control signals cause one or more of the signal-responsive, adjustable-height support assemblies to reduce their height in a preselected pattern, whereby the top surface support of the wave-responsive mattress/control assembly is adjusted in a predetermined pattern.

With another variation of the invention, the spring defines an interior space within the spring, and the compression/expansion assembly is contained between two or more of these interior spaces. One or more links link portions of two or more springs together, and at least one signal-responsive, adjustable-height support assembly is connected to one or more links. In this way, plural springs are contracted by the at least one signal-responsive, adjustable-height support assembly.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In view of the above, an object of the present invention is to provide an automatic mattress surface contour and support changing apparatus which positively and continuously identifies the exact mattress location(s) under the sore portion(s) of a person's body who is laying on the mattress.

If the person moves the sore portion(s) of his body to new mattress location(s), the apparatus automatically identifies the new location(s).

Another object of the present invention is to provide an automatic mattress surface contour and support changing apparatus which reduces or minimizes the upward force exerted by a mattress on sore portions of a person's body.

Still another object of the present invention is to provide an automatic mattress surface contour and support changing apparatus that automatically adjusts its top surface contour to accommodate sore portions of a person's body.

Yet another object of the present invention is to provide an automatic mattress surface contour and support changing apparatus which does not require a sore portion of a person's body to exert a downward pressure on a pressure sensor in order to adjust the surface contour of a mattress.

Even another object of the present invention is to provide an automatic mattress surface contour and support changing apparatus that reduces pain engendered by bed sores by preventing the bed sores from being exposed to cyclically repeated wave-like contact with a mattress surface.

Still a further object of the present invention is to provide an automatic mattress surface contour and support changing apparatus which automatically adjusts its top surface contour and support to accommodate sore portions of a person's body so that portions of the person's weight that are not supported by the mattress are redistributed to other portions of the mattress.

Yet another object of the present invention is to provide an automatic mattress surface contour and support changing apparatus that can provide that a relatively large portion of a supporting mattress retracts when a relatively large sore area on a patient approaches the mattress.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description. Such description makes reference to the annexed drawings wherein.

DETAILED DESCRIPTION

With reference to the drawings, an automatic mattress surface contour and support changing apparatus embodying the principles and concepts of the present invention will be described.

Figure 1:
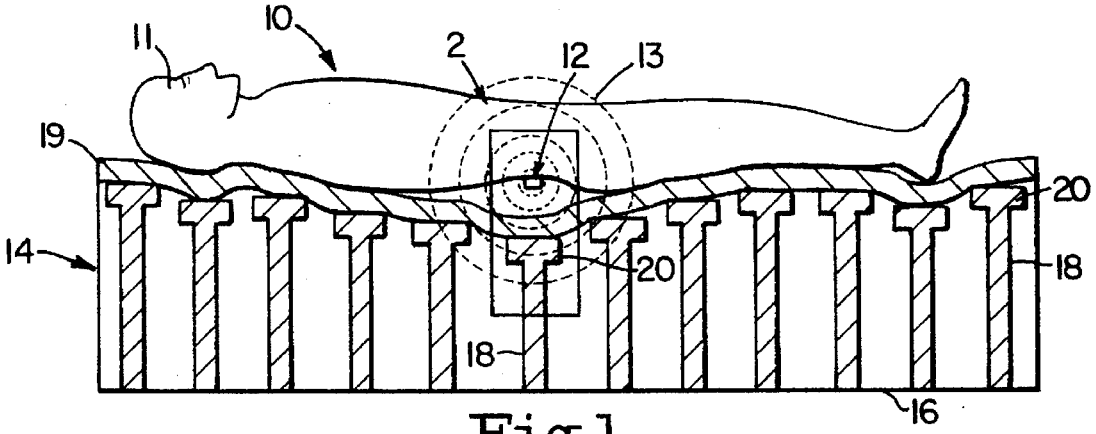
FIG. 1 is a side cross-sectional view showing a first embodiment of the automatic mattress surface contour and support changing apparatus of the invention in which a permanent magnet is used as a wave emitter, a reed switch is used as a wave sensor, and the signal-responsive, adjustable-height support assemblies are shown in generic form.
Figure 2:
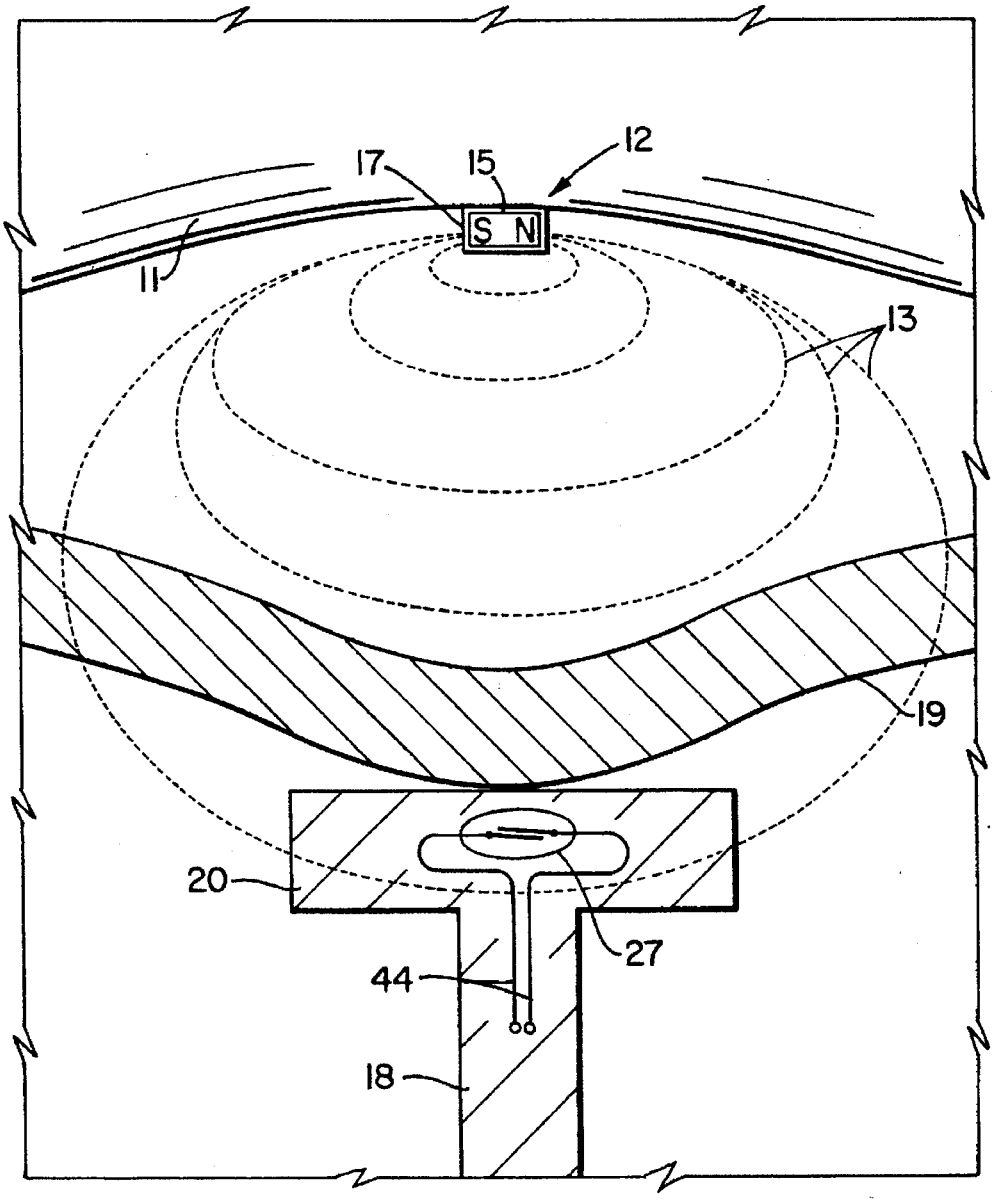
FIG. 2 is an enlarged portion of the embodiment of the invention shown in region 2 of FIG. 1.
Figure 3:
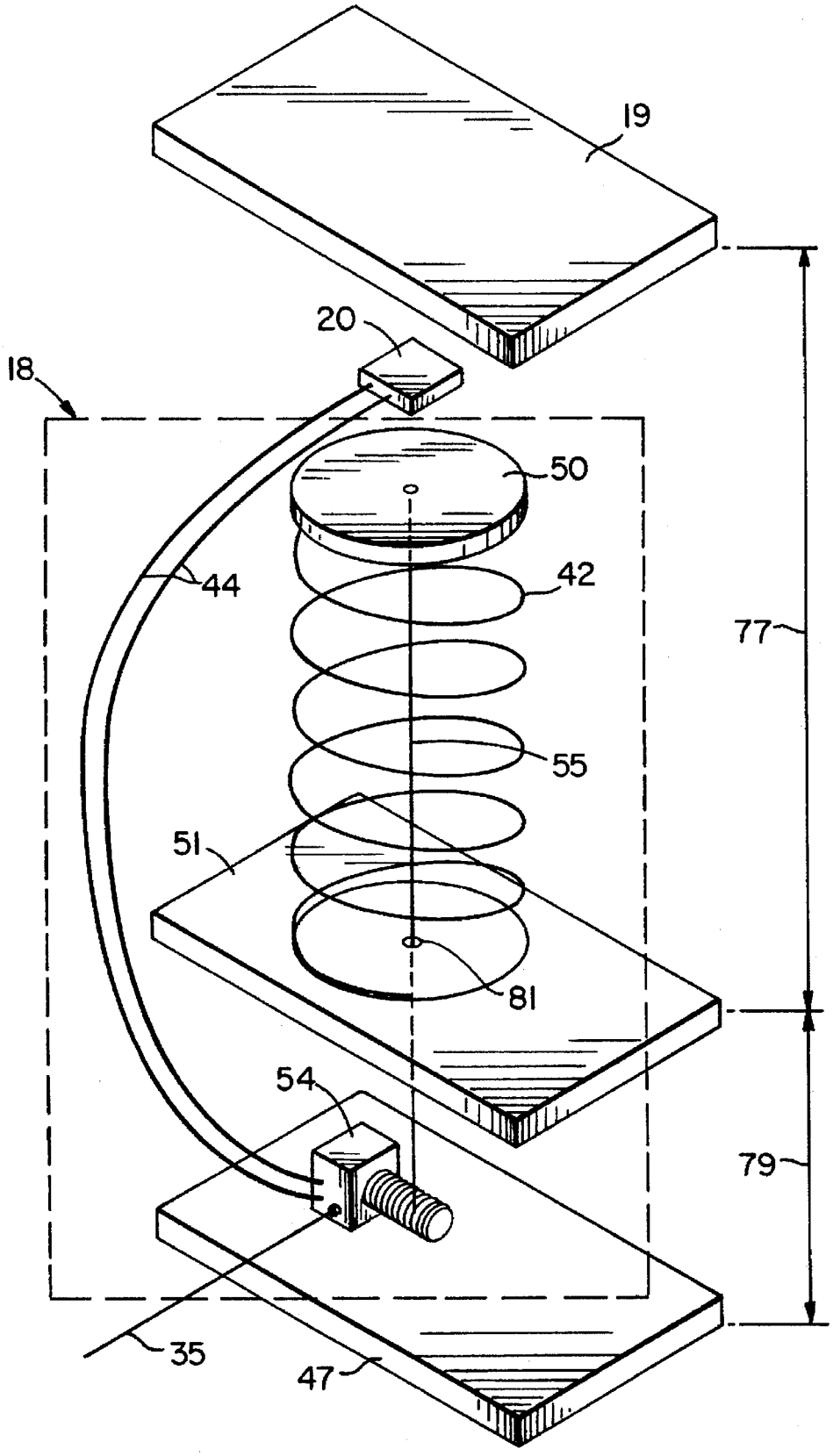
FIG. 3 is partial cross-sectional view of the first embodiment of the automatic mattress surface contour and support changing apparatus of the invention, showing a signal-responsive, adjustable-height support assembly, which includes a compression/expansion assembly beneath and along the center line of an adjustable-length spring assembly. In this embodiment the compression/expansion assembly includes an electric motor, a wire (serving as a flexible compression cable), and means for connecting the wire to the top of the spring.

Turning initially to FIGS. 1–3, there is shown a first exemplary embodiment of the automatic mattress surface contour and support changing apparatus of the invention generally designated by reference numeral 10. With this embodiment, the automatic mattress surface contour and support changing apparatus 10 includes a wave-emitter assembly 12 which is worn in the vicinity of a sore spot on a person 11 lying in bed and which emits waves 13. A wave-responsive mattress/control assembly 14 responds to the waves 13 of the wave-emitter assembly 12 for adjusting top surface support characteristics of the wave-responsive mattress/control assembly 14. In actuality, a person 11 can wear more than one wave-emitter assembly 12. A person, when lying on the wave-responsive mattress/control assembly 14, is supported by the top support surface.

In accordance with the embodiments of the invention shown in FIGS. 1–3, the wave-responsive mattress/control assembly 14 includes a housing assembly 16, a plurality of signal-responsive, adjustable-height support assemblies 18 housed within the housing assembly 16, and a top layer 19 covering and supported by the plurality of signal-responsive, adjustable-height support assemblies 18. The top layer 19 provides a top support surface for supporting the person 11. A plurality of wave sensor assemblies 20 are ready to sense waves 13 from a wave-emitter assembly 12 when the wave-emitter assembly 12 moves substantially close to one or more of the wave sensor assemblies 20. Each wave sensor assembly 20 is connected to an associated signal-responsive, adjustable-height support assembly 18. Each wave sensor assembly 20 sends a height-reduction control signal to an associated signal-responsive, adjustable-height support assembly 18 when waves 13 are sensed by the wave sensor assembly 20. The height-reduction control signal causes the signal-responsive, adjustable-height support assembly 18 to reduce its height, whereby the top surface support of the wave-responsive mattress/control assembly 14 is adjusted, that is, retracted away from the wave-emitter assembly 12.

Also, in the embodiment of the invention depicted in FIGS. 1–3, the wave-emitter assembly 12 includes a permanent magnet 15. A non-magnetic jacket 17 surrounds the permanent magnet 15. The wave sensor assemblies 20 are comprised of reed switch-based sensors. Each reed switch-based sensor includes a reed switch 27.

Generally, each signal-responsive, adjustable-height support assembly 18 includes an adjustable-length spring assembly and a compression/expansion assembly connected to the adjustable-length spring assembly. As shown in FIG. 3, the adjustable-length spring assembly can include a spring 42, a portion of plate 51 which extends to other adjustable-length spring assemblies, an electric motor 54, and a portion of flexible compression cable 55. The compression/expansion assembly is contained beneath the spring and along its center line.

Figure 4:
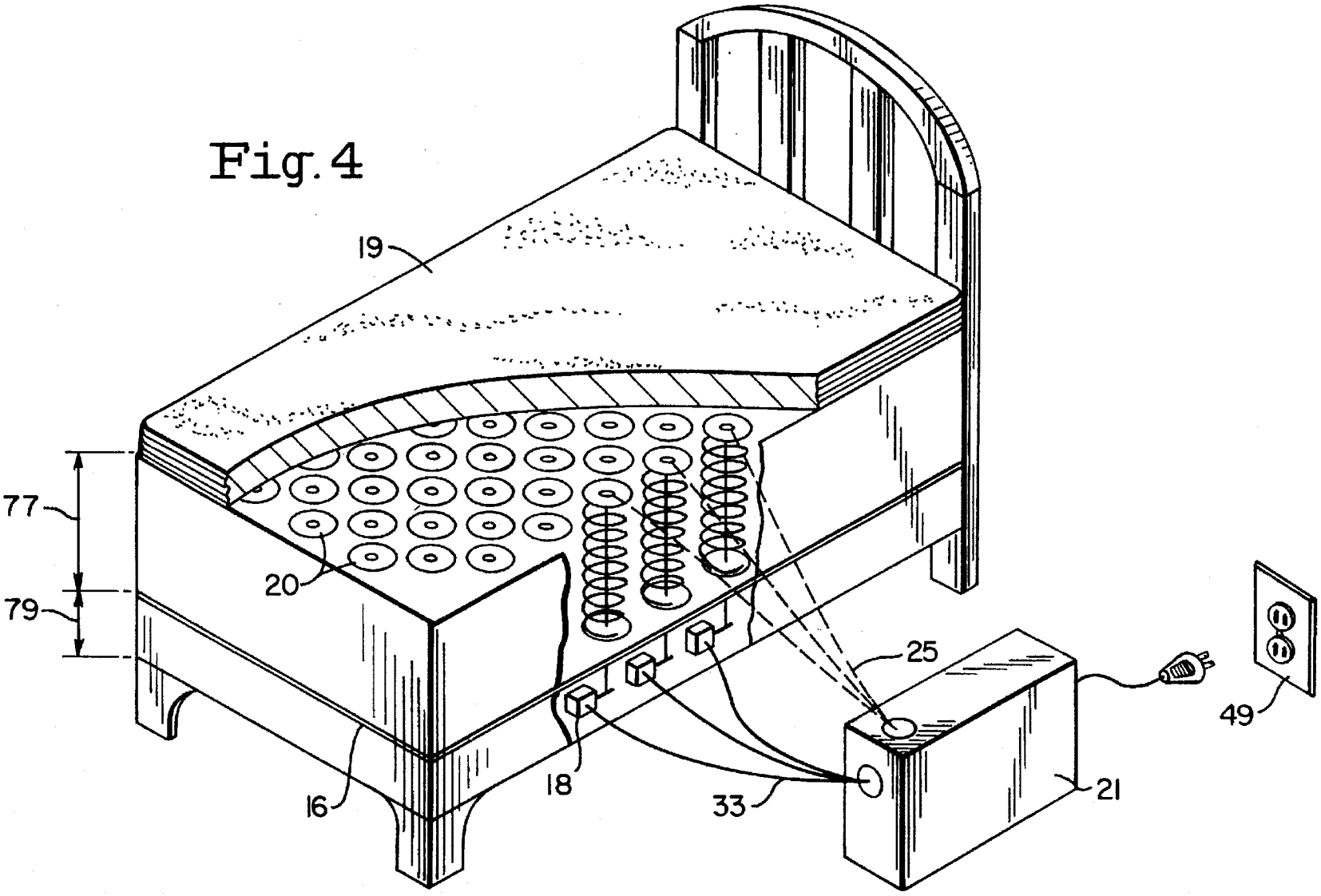
FIG. 4 is a perspective view of a second embodiment of the invention which includes a common control unit for receiving signals from all of the wave sensors and for controlling all of the signal-responsive, adjustable-height support assemblies.

More specifically with the embodiment of the invention shown in FIGS. 1–3, and as also shown in FIG. 4, the housing assembly 16 includes a top housing portion 77 for housing the adjustable-length spring assemblies and includes a bottom housing portion 79 for housing the compression/expansion assemblies, that is, the electric motor 54 and a portion of the flexible compression cable 55. Access openings 81 in plate 51 permit each flexible compression cable 55 to extend from the top housing portion 77 to the bottom housing portion 79.

More specifically with respect to the embodiment of the invention shown in FIGS. 1–3, a wave-emitter assembly 12 can include a permanent magnet 15. The wave sensor assemblies 20 can be reed switch-based sensors. Each reed switch-based sensor includes a reed switch 27. Permanent magnets and reed switch-based sensors are commonly used in home burglar alarms and are available as emitter/sensor pairs at many electrical supply stores.

In using the magnet/reed switch emitter/sensor pair, the wave-emitter magnet assembly 12 is attached to the person 11. More specifically, the magnet assembly 12 can be pinned or clipped onto a person's garment, such as pajamas, or taped to his skin. The magnet assembly 12 is attached in the vicinity of a portion of the person's body which is especially susceptible to pain. For example, if the person has a tender back, the magnet assembly 12 is attached in the vicinity of the tender back. If the person has a sore spot on his body, the magnet assembly 12 is attached at that specific location. Then, when the person changes positions on the top layer 19 of the wave-responsive mattress/control assembly 14, and when the magnet assembly 12 is moved near a specific reed switch-based magnetic wave sensor assembly 20, the approach of the magnetic field causes the reed switch to open (close), which provides a height-reduction control signal, which goes to the associated signal-responsive, adjustable-height support assembly 18 to cause the signal-responsive, adjustable-height support assembly 18 to retract and shorten its height. As a result, the top layer 19 of the wave-responsive mattress/control assembly 14 adjacent to the magnet assembly 12 is retracted away from the magnet assembly 12. In this way, the top surface support of the wave-responsive mattress/control assembly 14 is automatically adjusted as the magnet assembly 12 approaches the top layer 19 of the wave-responsive mattress/control assembly 14. It is noted that for the purposes of the present invention, magnetic fields, magnetic lines of flux, and magnetic waves are deemed to be equivalent.

Subsequently, when the person 11 further changes position on the top layer 19 of the wave-responsive mattress/control assembly 14, the magnet assembly 12 moves away from the reed switch-based magnetic wave sensor assembly 20. When this occurs, the departure of the magnetic field causes the reed switch to close (open), which provides a height-enlargement control signal, which goes to the associated signal-responsive, adjustable-height support assembly 18 to cause the signal-responsive, adjustable-height support assembly 18 to expand and lengthen its height to return to its normal position. As a result, the top layer 19 of the wave-responsive mattress/control assembly 14 adjacent to the departing magnet assembly 12 is extended upward. In this way, the top surface support of the wave-responsive mattress/control assembly 14 is automatically adjusted to its normal position when the magnet assembly 12 moves away from the top layer 19 of the wave-responsive mattress/control assembly 14.

As shown in FIG. 3, the signal-responsive, adjustable-height support assembly 18 can be implemented with an adjustable-length spring assembly and a compression/expansion assembly which includes an electric motor 54, a portion of plate 51, a flexible compression cable 55, and a rigid disk 50. As the electric motor 54 rotates its shaft in one direction, the flexible compression cable 55 is wound around the motor shaft, which compresses the spring, causing the top layer 19 to be retracted away from the person who is wearing the wave-emitter assembly 12. On the other hand, after the top layer 19 has been retracted away from the wave-emitter assembly 12, and the person changes position on the wave-responsive mattress/control assembly 14 causing the wave-emitter assembly 12 to move away from the wave sensor assemblies 20, then the opposite signal provided by the reed switch 27 causes the electric motor 54 to rotate its shaft in the opposite direction, which allows the spring to expand to its original length. In this way, the surface contour of the top layer 19 adjacent to the signal-responsive, adjustable-height support assembly 18 is restored to its original surface contour and support. Electric power is provided to the electric motor via conductor assembly 35. Signals from the reed switch travel through two conductors 44 to the electric motor 54, which responds to the signals. A bottom pad 47 can be placed between the bottom of the compression/expansion assembly and the bottom of the housing assembly 16.

Figure 8:
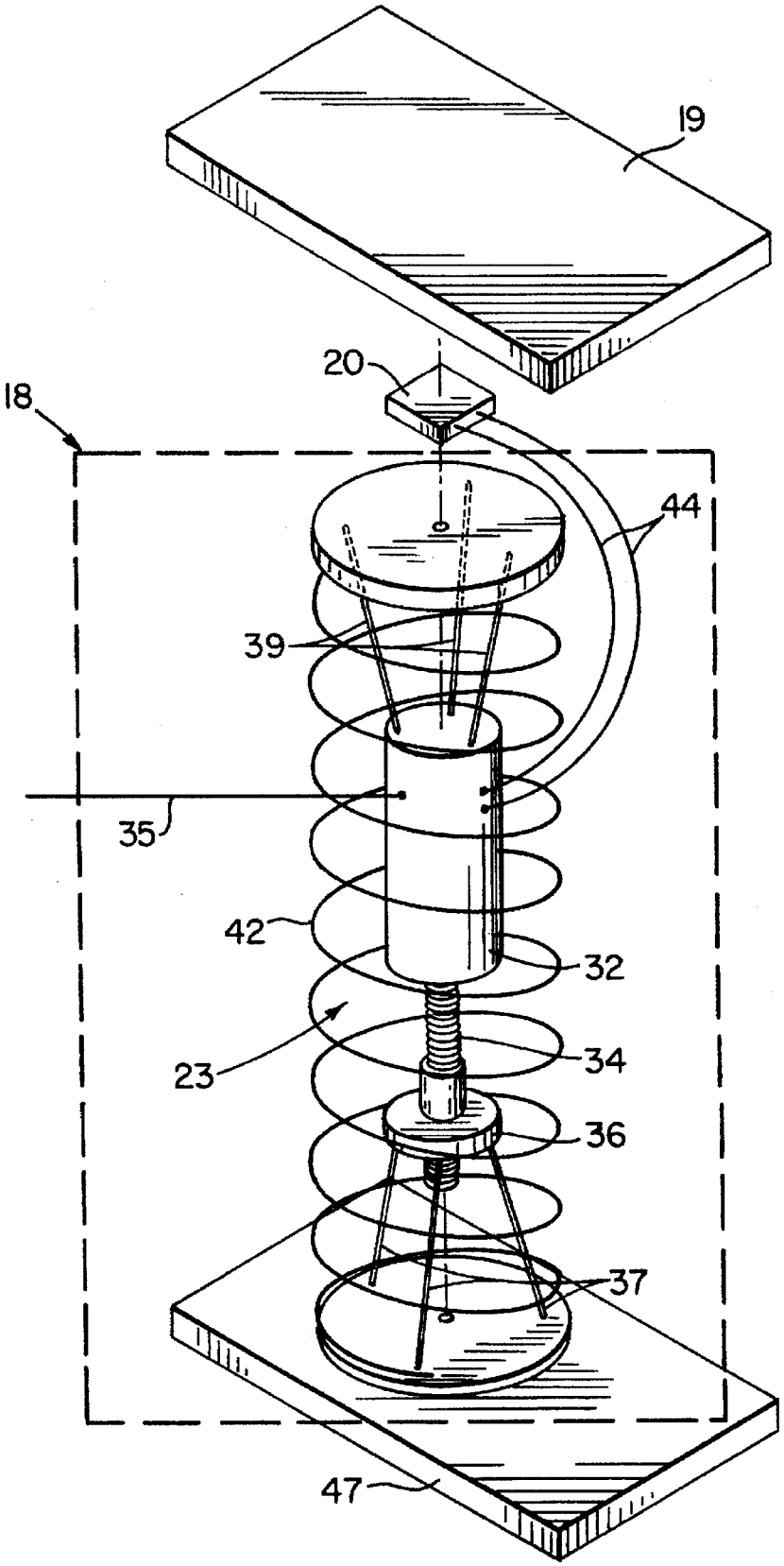
FIG. 8 is a partial cross-sectional view of another embodiment of the invention in which the compression/expansion assembly includes a commercially available screw-type linear actuator suspended within the interior space of a spring by flexible suspension wires.

The signal-responsive, adjustable-height support assembly 18 can also be implemented as shown in FIG. 8. In this variation, the spring defines an interior space within the spring. A commercially available linear actuator which includes an electric motor 32, a screw shaft 34 driven by the motor 32, and a ball nut assembly 36 which receives the screw shaft 34. The linear actuator is suspended within the interior space 23 of the spring 42 by a first set of suspension wires 37 connected between the ball nut assembly 36 and one end of the spring 42 and by a second set of suspension wires 39 connected between the housing of the electric motor 32 and another end of the spring 42. As the electric motor rotates the screw shaft in one direction, the screw shaft pulls the ball nut toward the electric motor, which compresses the spring. When the electric motor rotates the screw shaft in the other direction, the ball nut is pushed away from the electric motor. In this way, the spring can be compressed and released.

Although not illustrated in the drawings, the signal-responsive, adjustable-height support assembly 18 can be implemented in numerous other ways. One means is with an adjustable-length spring assembly and a compression/expansion assembly which includes a power solenoid assembly. A power solenoid assembly could not be used in conjunction with the permanent magnet emitter described above because the magnetic field produced by the power solenoid would interfere with the sensing of the magnetic fields produced by the magnet asssembly 12, but it could be used in conjunction with other possible emitters to be described later. The power solenoid assembly can include a coil portion, a coil actuation portion, and a plunger portion. When the coil actuation portion receives a height-reduction control signal from a wave sensor assembly 20, the coil portion is actuated and pulls the plunger portion downward, away from the top layer 19. When this occurs, the top of the adjustable-length spring assembly is pulled downward causing the spring 42 to be compressed and causing the top layer 19 to be retracted away from the person who is wearing the wave-emitter assembly 12. On the other hand, after the top layer 19 has been retracted away from the wave-emitter assembly 12, and the person changes position on the wave-responsive mattress/control assembly 14 causing the wave-emitter assembly 12 to move away from the wave sensor assemblies 20, then the plunger portion can be extended upward toward the retreating wave-emitter assembly 12. In this way, the surface contour of the top layer 19 adjacent to the plunger portion is restored to its original surface support. Also, although not illustrated in the drawings, the signal-responsive, adjustable-height support assemblies 18 can be implemented in various other ways, including hydraulically or pneumatically operated pistons, or individually adjustable air- or water-filled cells.

Figure 5:
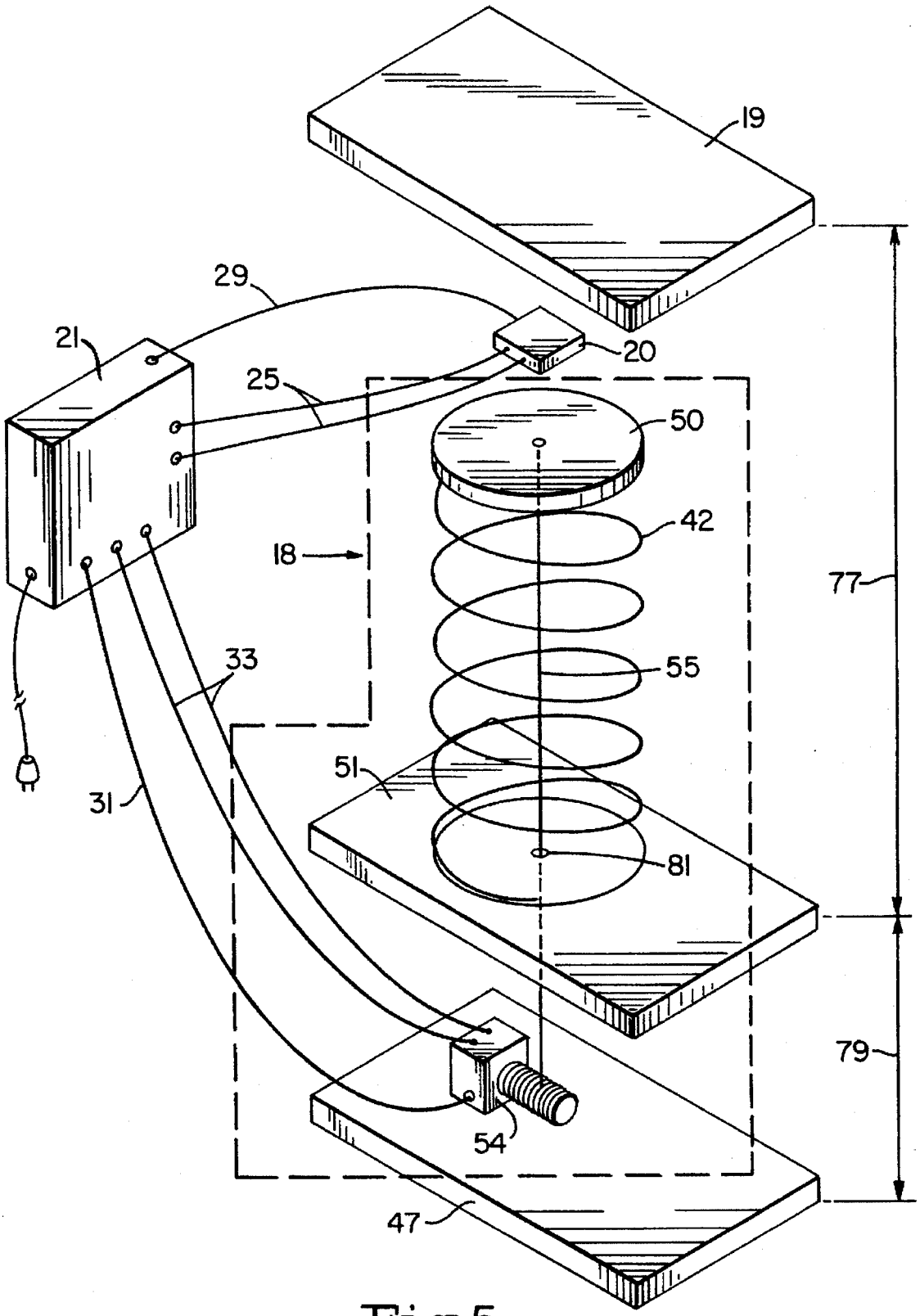
FIG. 5 is an exploded partial perspective view of a portion of the embodiment of the invention shown in FIG. 4 in which a signal-responsive, adjustable-height support assembly includes a compression/expansion assembly beneath and along the center line of an adjustable-length spring assembly.

In accordance with the embodiment of the invention shown in FIGS. 4 and 5, the wave-responsive mattress/control assembly 14 includes a housing assembly 16, a plurality of signal-responsive, adjustable-height support assemblies 18 housed within the housing assembly 16, and a common control unit 21 connected to each wave sensor assembly 20 and to each signal-responsive, adjustable-height support assembly 18. As stated above, the housing assembly 16 includes a top housing portion 77 for housing the adjustable-length spring assemblies and includes a bottom housing portion 79 for housing the compression/expansion assemblies. A top layer 19 covers and is supported by the plurality of signal-responsive, adjustable-height support assemblies 18 and provides a top support surface for supporting the person 11. A plurality of wave sensor assemblies 20 sense waves 13 from the wave-emitter assembly 12 when the wave-emitter assembly 12 moves substantially close to one or more of the wave sensor assemblies 20. Each wave sensor assembly 20 that senses the wave-emitter assembly 12 sends a signal to the common control unit 21. The common control unit 21 sends a height-reduction control signal to one or more of the signal-responsive, adjustable-height support assemblies 18 when waves 13 are sensed by one or more of the wave sensor assemblies 20. The one or more height-reduction control signals causes one or more of the signal-responsive, adjustable-height support assemblies 18 to reduce their height in a selected pattern, whereby the top surface contour and support of the wave-responsive mattress/control assembly 14 is adjusted.

More specifically with respect to %he operation of the embodiment of the invention shown in FIGS. 4 and 5, the signal or signals received from one or more wave sensor assemblies 20 travel through signal-carrying conductors 25 to the common control unit 21 and can be processed by the common control unit 21 in various ways to accomplish various goals. For example, a single wave-emitter assembly 12 can be attached to a patient's garment in the vicinity of a sore portion of the patient's body. One or more wave sensor assemblies 20 may sense waves 13 emitted from the wave-emitter assembly 12 when the wave-emitter assembly 12 is moved into the vicinity of the one or more wave sensor assemblies 20. The one or more wave sensor assemblies 20 send individual signals to the common control unit 21 (which may be a programmable digital computer along with a keyboard and a monitor). The common control unit 21 is plugged into a standard AC wall outlet 49. The common control unit 21 processes the signals from the wave sensor assemblies 20, and based on the processing of those wave-sensor-assembly signals, the common control unit 21 controls a plurality of signal-responsive, adjustable-height support assemblies 18 in a predetermined pattern via signal-carrying conductors 33.

The predetermined pattern of control of the signal-responsive, adjustable-height support assemblies 18 can be in the form of a circular pattern. The signal-responsive, adjustable-height support assembly 18 closest to the wave-emitter assembly 12 is in the center of the circle of the circular pattern. There can be a variety of choices of sizes and depths of the circular pattern based upon a selectable radius of the circle and amount of retraction. For example, for a small burn, the radius of the circular pattern can be small. For a large burn, the radius of the circular pattern can be large. Alternatively, a rectangular pattern of control of signal-responsive, adjustable-height support assemblies 18 can be based upon sensing the waves 13 emitted by one wave-emitter assembly 12.

The predetermined pattern pattern of control may also involve an offset distance and direction. This would be especially beneficial for burns and bed sores, in which attaching a wave-emitter assembly to the sore spot on the patient would be painful. One or more wave-emitter assemblies could be attached to the patient at a specific distance and direction away from the sore spot. For example, if the wave-emitter assembly was attached to the patient three inches to the left of the sore spot, then the common control unit would cause the signal-responsive adjustable-height support assembly three inches to the right of the wave emitter assembly to retract. If two or more wave-emitter assemblies were all attached to the patient at specified offset distances and/or directions, the common control unit could be programmed to identify the exact mattress location of the sore spot with simple geometric calculations.

More specifically, the common control unit 21 can provide a menu of predetermined patterns of control of the signal-responsive, adjustable-height support assemblies 18 to select. In view of what has been discussed above, the menu can have at least the following choices of predetermined patterns of adjustable-height-support-assembly control (a) a one-to-one correspondence between each wave sensor assembly 20 and a single associated signal-responsive, adjustable-height support assembly 18, (b) a predetermined circular pattern of signal-responsive, adjustable-height support assemblies 18 that are controlled by the common control unit 21 based on one (or more) wave sensor assembly 20 sensing the emitted waves 13, (c) a predetermined rectangular pattern of signal-responsive, adjustable-height support assemblies 18 that are controlled by the common control unit 21 based on one (or more) wave sensor assembly 20 sensing the emitted waves 13, and (d) a predetermined offset pattern of signal-responsive, adjustable-height support assemblies 18 that are controlled by the common control unit 21 based on one or more wave sensor assemblies 20 sensing the emitted waves 13. A large number of other predetermined patterns of control of signal-responsive, adjustable-height support assemblies 18 can also be conceived and added to the menu of choices. Additional menu choices can be provided with respect to the variations in the sizes, depths, and times of the various patterns selected. For example, the common control unit 21 could be programmed to be enabled for a period of time, e.g. six hours, and to be disabled for another period of time.

Instead of using a programmable digital computer to implement the common control unit 21, as an alternative, the common control unit 21 can contain a plurality of hard-wired patterns of control for the signal-responsive, adjustable-height support assemblies 18. As a supplement to or as an alternative to employing a menu, the common control unit 21 can provide an interactive program with an operator whereby the operator provides information or answers to programmed queries or questions. The common control unit 21 can make predetermined computations based on the operator's answers to provide patterns of control of the signal-responsive, adjustable-height support assemblies 18.

The common control unit 21 can perform additional functions. For example, if the wave sensor assemblies 20 have active components which need electrical power to operate, the common control unit 21 can provide power to the wave sensor assemblies 20 through power-carrying conductor assembly 29. The common control unit 21 can also supply power to the signal-responsive, adjustable-height support assemblies 18 through power line assembly 31. The signal-responsive, adjustable-height support assemblies 18 may be controlled directly by control signals from the common control unit 21. The control signals can be sent from the common control unit 21 to the signal-responsive, adjustable-height support assemblies 18 through control lines 33.

Figure 6:
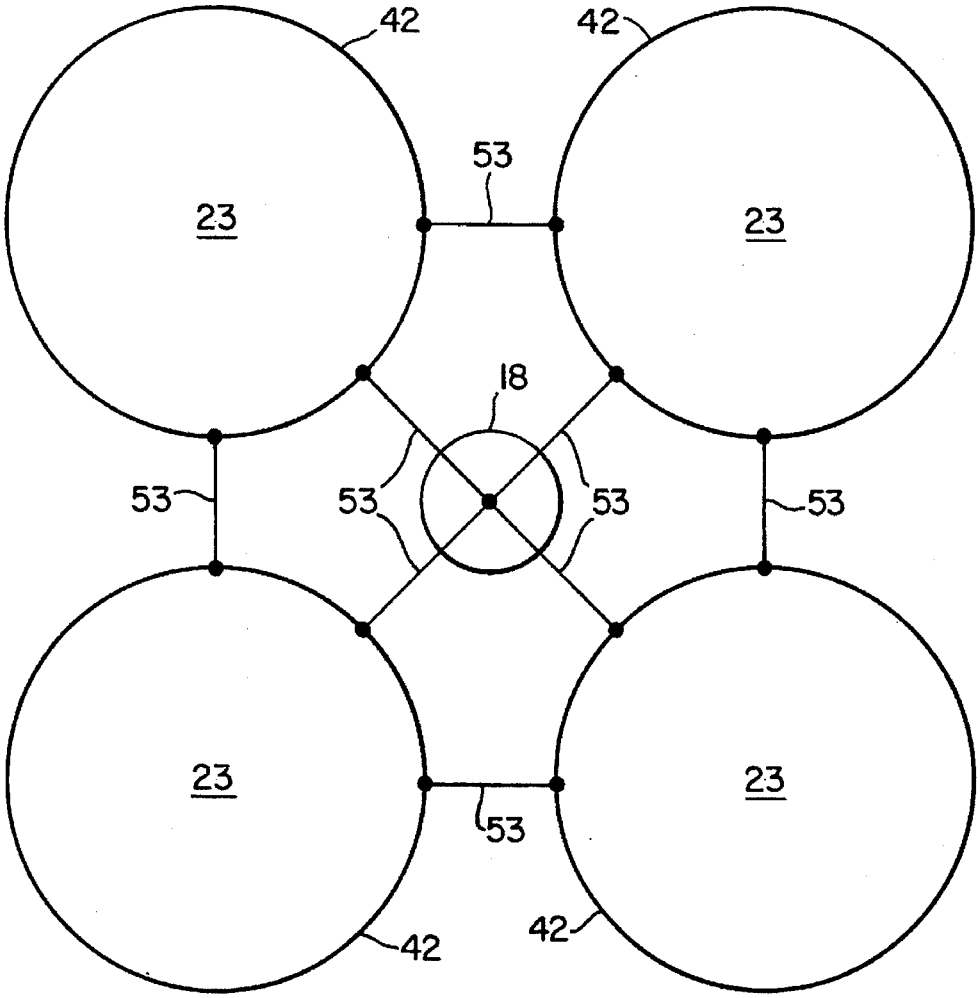
FIG. 6 is a schematic view of a portion of a third embodiment of the invention in which a signal-responsive, adjustable-height support assembly is located between two or more springs and in which portions of plural springs are controlled by a single signal-responsive, adjustable-height support assembly.

As shown in the third embodiment of the invention illustrated in FIG. 6, the spring 42 defines an interior space 23 within the spring 42, and the compression/expansion assembly is contained outside and between two or more of these interior spaces 23. One or more links 53 link portions of two springs 42 together, and at least one signal-responsive, adjustable-height support assembly 18 is connected to one or more links 53. In this way, plural springs are contracted by the at least one signal-responsive, adjustable-height support assembly 18.

The wave-emitter assembly 12 and the corresponding wave sensor assemblies 20 can be implemented in a number of additional ways. For example, the magnetic sensor in the first embodiment could be a solenoid coil. As another example, the wave-emitter assembly 12 can emit acoustic waves, and the wave sensor assemblies 20 can sense acoustic waves. As yet another example, the wave-emitter assembly 12 can emit heat waves providing a temperature field, and the wave sensor assemblies 20 can sense the resulting temperature field. It is further stated that for purposes of the present invention, fields and waves produced by an emitter worn by a person are deemed to be equivalent.

As an example of another alternative, for purposes of the present invention, heat waves may be emitted by a relatively high-temperature portion of a person's body, such as a sore region. Such heat waves may heat an outer garment such as pajamas to provide additional heat waves. Such heat waves, are deemed to be emitted waves, and the high-temperature portion of the person and/or the person's garment is equivalent to being a wave-emitting assembly that is "worn" by the person. In this respect, the wave sensor assemblies can be sensitive to the heat waves resulting from high-temperature portions of the person's body and/or garments.

The wave-emitter assembly 12 can also emit electromagnetic waves, and the wave sensor assemblies 20 can sense electromagnetic waves. As a special subset of electromagnetic wave emitters and sensors, the wave-emitter assembly 12 can emit radio waves, and the wave sensor assemblies 20 can sense the radio waves. More specifically, the wave sensor assemblies 20 can sense distance from or proximity to a radio-wave-emitting wave-emitter assembly 12. As a result, an array of radio-wave-detecting wave sensor assemblies 20 can send a pattern of signals of varying signal strength to the common control unit 21 which can compute a pattern of height variation of the signal-responsive, adjustable-height support assemblies 18 based on the pattern of signal intensities received by the radio-wave-detecting wave sensor assemblies 20.

Figure 7:
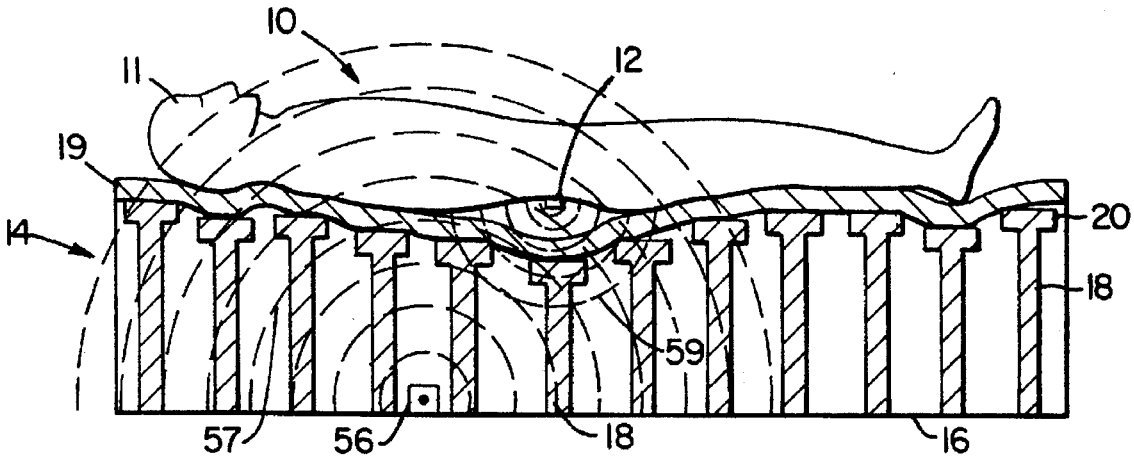
FIG. 7 is a side cross-sectional view of another embodiment of the invention in which a radar wave source is located inside the mattress and in which radar waves are reflected from the emitter on the patient.

Another special subset of electromagnetic wave emitters and sensors is shown in FIG. 7, in which the wave-emitter assembly 12 actually reflects radar waves 57 which have been transmitted from one or more radar sources 56 in or under the mattress. For purposes of the present invention, the radar waves 59 that have been reflected by the radar-reflective material are deemed to be emitted by the radar-reflective material to be sensed by the wave sensor assemblies. In this case, the wave-emitter assembly 12 would not require its own battery or other power source. The radar-wave-reflecting wave-emitter assembly 12 can be a thin, flexible disk of radar-reflecting material such as aluminum foil. As stated above, the wave sensor assemblies 20 can sense the reelected radar waves from the wave-emitter assembly 12. The signals from the wave sensor assemblies 20 are sent to the common control unit 21. The system can positively identify the exact mattress location under the radar-wave-reflecting wave-emitter assembly 12.

As described above, the automatic mattress surface contour and support changing apparatus 10 is literally in the form of a mattress, that is, a horizontal support surface for a reclining person. It is understood, however, that the invention is also usable when a person is sitting on a mattress as is often the case. Moreover, for purposes of the present invention, the so-called mattress can be oriented in a vertical orientation. When such is the case, a vertically oriented form of the invention can be used as a back of a chair. Furthermore, a horizontally oriented portion can be used in conjunction with a vertical oriented portion to provide an automatic chair-surface-contour-and-support-changing apparatus of the invention. Therefore, for purposes of the present invention, a chair is deemed to be equivalent to a mattress.

The components of the automatic mattress surface contour and support changing apparatus of the invention can be made from inexpensive and durable metal and plastic materials and readily available electronic components.

It is apparent from the above that the present invention accomplishes all of the objects set forth by providing an automatic mattress surface contour and support changing apparatus that is low in cost, relatively simple in design and operation, and which may advantageously be used to positively and continuously identify the mattress location(s) which are under the sore portion(s) of a person's body who is reclining on the mattress. With the invention, an automatic mattress surface contour and support changing apparatus is provided which automatically reduces or minimizes the upward force exerted by a mattress on sore portions of a person's body. With the invention, an automatic mattress surface contour and support changing apparatus is provided which automatically adjusts its top surface contour and support to accommodate sore portions of a person's body. With the invention, an automatic mattress surface contour and support changing apparatus is provided which does not require a sore portion of a person's body to exert a downward pressure on a pressure sensor in order to adjust the surface contour of a mattress. With the invention, an automatic mattress surface contour and support changing apparatus is provided which reduces pain engendered by bed sores by preventing the bed sores from being exposed to cyclically repeated wave-like contact with a mattress surface. With the invention, an automatic mattress surface contour and support changing apparatus is provided which automatically adjusts its top surface contour and support to accommodate sore portions of a person's body so that portions of the person's weight that are not supported by the mattress are redistributed to other portions of the mattress. With the invention, an automatic mattress surface contour and support changing apparatus is provided which can provide that a relatively large portion of a supporting mattress retracts when a relatively large area on a patient approaches the mattress.

With respect to the above description, it should be realized that the optimum dimensional relationships for the parts of the invention, to include variations in size, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed is:

1. An automatic mattress surface contour and support changing apparatus, comprising:

a wave-emitter assembly, worn by a person supported by the mattress surface, which emits waves, and a wave-responsive mattress/control assembly which responds to said waves from said wave-emitter assembly for adjusting top surface support characteristics of said wave-responsive mattress/control assembly.

2. The apparatus of claim 1 wherein said wave-responsive mattress/control assembly includes:

a housing assembly, a plurality of signal-responsive, adjustable-height support assemblies housed within said housing assembly, a top layer covering and supported by said plurality of signal-responsive, adjustable-height support assemblies and providing a top support surface for supporting the person, and a plurality of wave sensor assemblies, located under said top layer, for sensing waves from said wave-emitter assembly and for providing signals used for controlling one or more of said signal-responsive, adjustable-height support assemblies when said wave-emitter assembly moves substantially close to one or more of said wave sensor assemblies.

3. The apparatus of claim 2 wherein said wave-emitter assembly includes:

a permanent magnet which provides magnetic waves and a non-magnetic jacket surrounding said permanent magnet.

4. The apparatus of claim 2 wherein each of said wave sensor assemblies includes a reed switch.

5. The apparatus of claim 2 wherein:

said wave-emitter assembly includes a quantity of radar-reflective material, said wave-responsive mattress/control assembly includes a radar wave generator for generating radar waves, a portion of which are reflected off of said radar-reflective material worn by the person, and said wave sensor assemblies include radar-wave-sensing sensors for sensing radar waves reflected off of said radar-reflective material worn by the person.

6. The apparatus of claim 2 wherein each wave sensor assembly is associated with and is connected to one of said signal-responsive, adjustable-height support assemblies, wherein each wave sensor assembly sends a height-reduction control signal to its associated signal-responsive, adjustable-height support assembly when waves are sensed by said wave sensor assembly, wherein said height-reduction control signal causes said associated signal-responsive, adjustable-height support assembly to reduce its height, whereby the top surface support of said wave-responsive mattress/control assembly is adjusted.

7. The apparatus of claim 2, further including a common control unit connected to each signal-responsive, adjustable-height support assembly, wherein each wave sensor assembly which senses waves from said wave-emitter assembly sends a signal to said common control unit, wherein said common control unit sends a height-reduction control signal to one or more of said signal-responsive, adjustable-height support assemblies when waves are sensed by one or more of said wave sensor assemblies, wherein said one or more height-reduction control signals causes one or more of said signal-responsive, adjustable-height support assemblies to reduce their height in a selected pattern, whereby the top surface support of said wave-responsive mattress/control assembly is adjusted.

8. The apparatus of claim 2 wherein each signal-responsive, adjustable-height support assembly includes:

an adjustable-length spring assembly, and a compression/expansion assembly connected to said adjustable-length spring assembly.

9. The apparatus of claim 8 wherein said wave-responsive mattress/control assembly includes a housing assembly which includes:

a top housing portion for housing said adjustable-length spring assemblies, a bottom housing portion for housing said compression/expansion assemblies, and access openings located between said top housing portion and said bottom housing portion.

10. The apparatus of claim 9 wherein:

each compression/expansion assembly includes a flexible compression cable which extends through an access opening between said bottom housing portion and said top housing portion and is connected to an adjustable-length spring assembly for compressing the adjustable-length spring assembly to which it is connected.

11. The apparatus of claim 8 wherein said adjustable-length spring assembly includes a spring which defines an interior space within said spring.

12. The apparatus of claim 11 wherein said compression/expansion assembly is contained within said interior space.

13. The apparatus of claim 12 wherein said compression/expansion assembly includes:

an electric linear actuator assembly which includes an electric motor which includes a motor housing, a screw shaft connected to said electric motor, and a ball nut assembly connected to said screw shaft, a first set of suspension wires connected between said ball nut assembly and one end of said spring, and a second set of suspension wires connected between said motor housing and another end of said spring.

14. The apparatus of claim 11 wherein said compression/expansion assembly is contained outside said interior space.

15. The apparatus of claim 14, further including:

one or more links which link portions of two or more springs together, wherein at least one compression/expansion assembly of at least one signal-responsive, adjustable-height support assembly is connected to said one or more links, whereby plural springs are contracted by said at least one signal-responsive, adjustable-height support assembly.

* * * * *